US010826644B2

(12) United States Patent
Hunt

(10) Patent No.: US 10,826,644 B2
(45) Date of Patent: Nov. 3, 2020

(54) BLOCKING JAMMING SIGNALS INTENDED TO DISRUPT COMMUNICATIONS

(71) Applicant: THE BOEING COMPANY, Chicago, IL (US)

(72) Inventor: Jeffrey H. Hunt, Thousand Oaks, CA (US)

(73) Assignee: THE BOEING COMPANY, Chicago, IL (US)

( * ) Notice: Subject to any disclaimer, the term of this patent is extended or adjusted under 35 U.S.C. 154(b) by 780 days.

(21) Appl. No.: 15/048,665

(22) Filed: Feb. 19, 2016

(65) Prior Publication Data

US 2017/0244511 A1 Aug. 24, 2017

(51) Int. Cl.
*H04K 3/00* (2006.01)

(52) U.S. Cl.
CPC ..... *H04K 3/224* (2013.01); *H04K 3/68* (2013.01)

(58) Field of Classification Search
None
See application file for complete search history.

(56) References Cited

U.S. PATENT DOCUMENTS 6,275,188 B1 * 8/2001 Chen ..... H01Q 3/2629 342/14
6,295,017 B1 * 9/2001 Ivanov ..... G01S 7/021 342/17
8,981,261 B1 3/2015 Tillotson
2003/0160724 A1 * 8/2003 Alexeff ..... H01Q 1/26 343/701
2009/0084252 A1 * 4/2009 Marquis ..... F41H 11/02 89/1.11
2009/0224958 A1 * 9/2009 Aphek ..... F41G 7/224 342/54
2010/0289688 A1 * 11/2010 Sherman ..... H04B 1/1036 342/16
2011/0266891 A1 * 11/2011 Lane ..... H04B 13/00 307/149
2012/0298650 A1 * 11/2012 Nowak ..... B23K 26/03 219/385
2016/0080709 A1 * 3/2016 Viswanathan ..... H04N 9/3155 353/85

OTHER PUBLICATIONS

Patent Application entitled Defense Mechanism Against Directed-Energy Systems Based on Laser Induced Atmospheric Optical Breakdown, U.S. Appl. No. 14/932,720, filed Nov. 4, 2015.

* cited by examiner

*Primary Examiner* — Frank J McGue
(74) *Attorney, Agent, or Firm* — Patterson + Sheridan, LLP

(57) ABSTRACT

Jamming systems uses wireless signals (e.g., radio waves) to deliberately prevent a target from accurately receiving desired wireless signals. The examples herein disclose an anti-jamming system that mitigates an effect that jamming signals have on a radio receiver. To do so, the anti-jamming system generates a plasma shield in a region of space between the target and the jamming system. Plasma is opaque to electromagnetic energy meaning that radio signals, lasers, microwave energy, and the like are unable to pass through the plasma, and instead, are absorbed by the plasma. As such, the jamming signals emitted by the jamming system are absorbed by the plasma shield and do not interfere with the target's radio receiver.

20 Claims, 5 Drawing Sheets

BLOCKING JAMMING SIGNALS INTENDED TO DISRUPT COMMUNICATIONS

FIELD

The present disclosure relates to anti-jamming systems, and more specifically, to generating a plasma shield to counter jamming signals.

BACKGROUND

Radio jamming is a technique that deliberately blocks, jams or interferes with wireless communication. Intentional communications jamming is usually aimed at radio signals to prevent a communication system from receiving signals. A transmitter, tuned to the same frequency as a targets' receiving equipment and with the same type of modulation, can, with enough power, override any signal at the receiver. The most common types of signal jamming include random noise, random pulse, stepped tones, warbler, random keyed modulated continuous wave (CW), and the like.

SUMMARY

One aspect described herein is an anti-jamming system that includes a pulsed laser source and an optical control system. The optical control system is configured to direct laser signals emitted by the pulsed laser source to generate a plasma shield in a defined plasma shield region located along a path traversed by a jamming signal in order to mitigate an effect the jamming signal has on a communication system.

Another aspect described herein is a system that includes a jamming signal detector configured to detect a jamming signal configured to interfere with a communication system, a laser source, and an optical control system. The optical control system is configured to, in response to detecting the jamming signal, direct a laser signal emitted by the laser source to generate a plasma in a defined plasma shield region.

Another aspect described herein is a method that includes detecting a jamming signal configured to interfere with a communication system and generating, in response to detecting the jamming signal, plasma in a plasma shield region disposed in a path on which the jamming signal traverses.

BRIEF DESCRIPTION OF THE SEVERAL VIEWS OF THE DRAWINGS

To facilitate understanding, identical reference numerals have been used, where possible, to designate identical elements that are common to the figures. It is contemplated that elements disclosed in one aspect may be beneficially utilized on other aspects without specific recitation.

DETAILED DESCRIPTION

Jamming systems uses wireless signals (e.g., radio waves) to deliberately prevent a target from accurately receiving desired wireless signals. In one aspect, the jamming system includes a transmitter that emits radio signals that disrupt communications by decreasing the signal-to-noise ratio of a receiver on a target. The examples herein disclose an anti-jamming system that mitigates the effect that the jamming signals have on a radio receiver. To do so, the anti-jamming system generates a plasma shield in a region of space between the target and the jamming system. Plasma is opaque to electromagnetic energy meaning that radio signals, lasers, microwave energy, and the like are unable to pass through the plasma, and instead, are absorbed by the plasma. As such, the jamming signals emitted by the jamming system are absorbed by the plasma shield and do not interfere with the target's radio receiver.

In one aspect, the anti-jamming system includes a jamming signal detector for detecting jamming signals. For example, the detector may process received radio signals to determine if the signals are jamming signals—e.g., whether the signals include random noise, random pulse, stepped tones, warbler, random keyed modulated CW, and the like. In one aspect, the jamming signal detector also identifies a direction of the transmitter emitting the jamming signals relative to the target, and in response, instructs the anti-jamming system to generate a plasma shield that absorbs some or all of the jamming signals before the signals can reach the target. Furthermore, because the plasma shield absorbs electromagnetic energy regardless whether the signals are undesired jamming signals or desired communication signals, in one aspect, the target adjusts a parameter of a communication system to avoid the plasma when transmitting communication signals to an external receiver. Put differently, because the target knows where the plasma shield is located, the target can change the radiation pattern or directionality of an antenna used to transmit the communication signals to avoid the plasma shield thereby reducing the amount of energy in the communication signals that is absorbed by the plasma.

Figure 1:
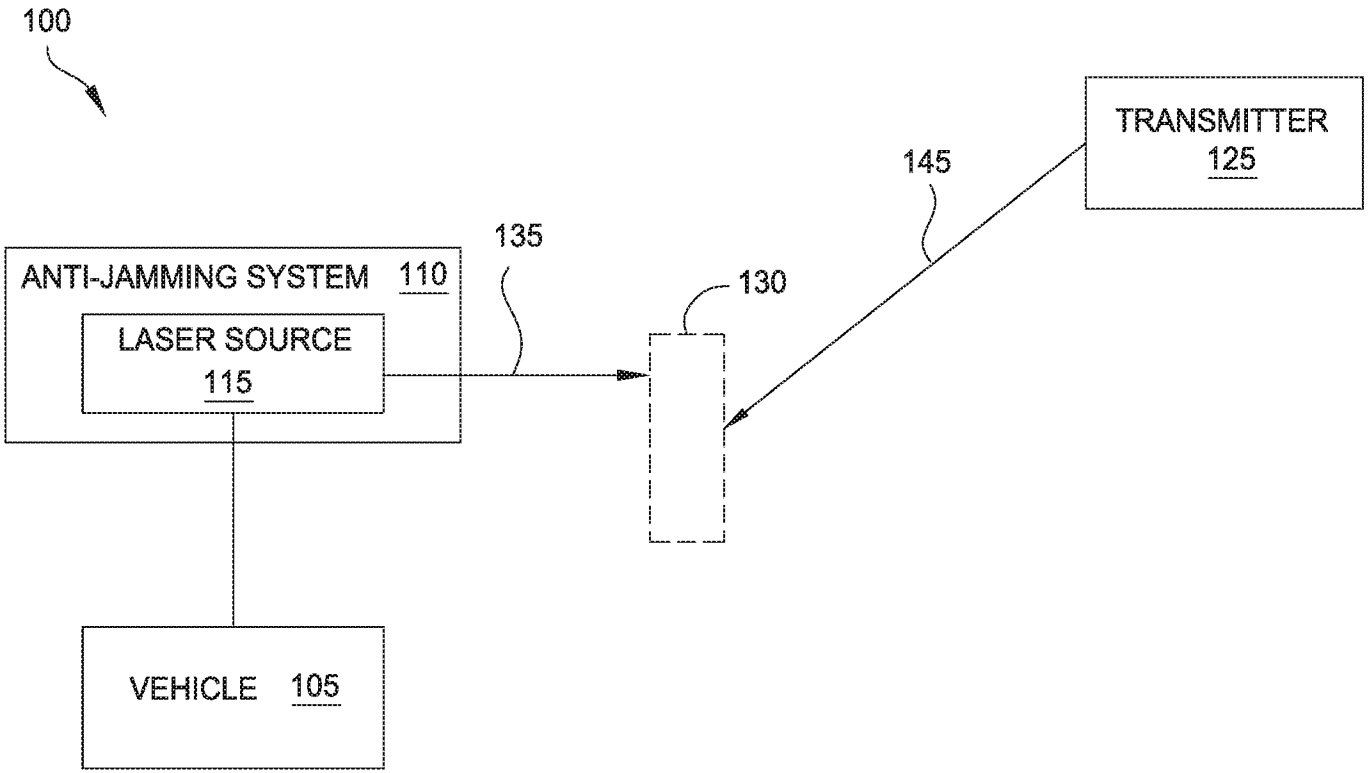
FIG. 1 illustrates an anti-jamming system for countering jamming signals.

FIG. 1 illustrates an anti-jamming system 110 for countering a transmitter 125 emitting jamming signals 145. In environment 100, the transmitter 125 emits the jamming signals 145 in order to interfere with a receiver (not shown) on a vehicle 105. That is, the jamming signal 145 (e.g., a radio wave) interferes with the ability of the receiver to accurately receive and decode data carried by wireless signals. The transmitter 125 can be any transmission system for generating and transmitting jamming signals 145. For example, the transmitter 125 may include an antenna which broadcasts jamming signals 145 in a general region, or the transmitter 125 may include a tracking system for directing the jamming signals 145 at the vehicle 105 as the vehicle 105 moves in the environment 100.

In one aspect, the transmitter 125 transmits noise using the jamming signals 145 which alter the signal to noise ratio of the receiver in the vehicle 105 such that any other communication signals received at the vehicle 105 cannot be decoded. In another aspect, the transmitter 125 may use subtle jamming techniques such as squelch capture, handshaking to keep the receiver in an infinite loop, or continuous transmission in a channel to prevent the target (e.g., vehicle 105) from using the channel.

As shown in FIG. 1, the anti-jamming system 110 is attached to the vehicle 105. The vehicle 105 may be a wheeled vehicle, tracked vehicle, aircraft, boat, and the like. Although a vehicle 105 is shown, in other aspects, the anti-jamming system 110 may be mounted on a stationary structure. For example, the anti-jamming system 110 may be mounted on or near a strategic building to protect communication systems at the location from being jammed.

The anti-jamming system 110 includes a laser source 115 that emits a laser 135 and generates a plasma in region 130 outlined by the dotted lines. The energy provided by the laser source 115 breaks the atomic bonds of the molecules within the region 130 to generate the plasma. For example, the laser 135 may ionize the molecules in region 130 by removing an electron from an atom or molecule in the gaseous state. These free electrons generate a plasma which absorbs electromagnetic energy (e.g., jamming signals 145) entering the region 130. Although ionizing the atoms in region 130 is sufficient to generate a plasma shield, in other examples, the laser 135 may provide enough energy to disassociate the molecular bonds in region 130. Stated generally, a plasma shield can be created by heating the gas in region 130 using the laser 135 or subjecting the gas to a strong electromagnetic field applied by the laser 135. In one aspect, the anti-jamming system 110 generates the plasma in the atmosphere (e.g., air) surrounding the vehicle 105. However, in other aspects, the anti-jamming system 110 may emit gas into the atmosphere that may enhance the plasma in the region 130. Put differently, the anti-jamming system 110 can emit a gas into region 130 that makes it easier for the laser source 115 to generate the plasma or generate denser plasma relative to relying solely on gaseous molecules already present in the atmosphere.

Because plasma is opaque to electromagnetic radiation, the jamming signals 145 striking region 130 cannot pass through the plasma shield. Furthermore, not only does the plasma shield mitigate or prevent the jamming signals 145 from reaching the vehicle 105 (i.e., the target), the jamming signals 145 also help to maintain the plasma shield. As the jamming signals 145 are absorbed in the plasma shield region 130, this energy may ionize more of the molecules within the shield region 130 thereby maintaining (or increasing) the density of the plasma within region 130. As such, even if energy emitted by the transmitter 125 is increased, the density of the plasma shield also increases thereby preventing the jamming signals 145 from reaching the vehicle 105.

The distance between the vehicle 105 and the plasma shield region 130 may vary depending on the application. One advantage of having the region 130 closer to the vehicle 105 is that the region 130 can guard the vehicle 105 from jamming signals originating from more directions than a region 130 located further from the vehicle 105. However, if the plasma shield is generated close to the vehicle, the heat from the plasma may harm the vehicle 105. Moreover, the plasma shield blocks all electromagnetic radiation, whether desired or undesired, from passing therethrough. Thus, having the plasma radiation close to the vehicle 105 may interfere which the ability of a communication system in the vehicle 105 (e.g., a radio) from transmitting radio waves. Thus, these all factors may be considered and balanced when selecting how far away from the vehicle 105 to generate the plasma shield. Different techniques for adjusting a communication system on the vehicle 105 in order to avoid the plasma in region 130 will be discussed later.

In one aspect, the anti-jamming system 110 may use a lens or lenses to control the focal point of the laser source 115 which dictates the location of the plasma shield region 130. In one aspect, the anti-jamming system 110 may generate the plasma shield anywhere from 5-10 centimeters to several meters from the vehicle 105. Furthermore, the anti-jamming system 110 may control the size of the plasma shield as well as the density of the plasma depending on the application. For example, when used to block jamming signals 145, the laser source 115 may generate a less dense plasma when compared to generating a plasma for blocking a directed-energy system as described in DEFENSE MECHANISM AGAINST DIRECTED-ENERGY SYSTEMS BASED ON LASER INDUCED ATMOSPHERIC OPTICAL BREAKDOWN, U.S. patent application Ser. No. 14/932,720 filed on Nov. 4, 2015 (which is incorporated by reference). That is, because of the larger wavelengths in a jamming signal 145 (e.g. signals ranging between 3 KHz to 300 GHz), the energy in the signal 145 may be spread out over a larger distance than signals outputted by a directed-energy system (e.g., a laser or microwave signal). Thus, plasma with lesser density may be sufficient to prevent the jamming signals 145 from reaching the vehicle 105 relative to the density of plasma used when blocking directed-energy systems. Conversely, because of the larger wavelengths of the jamming signals 145, the laser source 115 may generate a larger plasma shield to absorb more of the energy of the jamming signals 145 relative to a directed-energy system where the energy is focused in smaller regions of space. Stated differently, the plasma shield for block jamming signals 145 may have length and width dimensions (which are both substantially perpendicular to the direction of propagation of the laser 135) that are greater than the length and width dimensions of the plasma shield used to block directed-energy systems.

In one aspect, the anti-jamming system 110 can be used to block both jamming signals 145 as well as directed-energy weapons. When blocking jamming signals 145, the laser source 115 may generate a plasma shield that is less dense, but covers a larger 2-D area perpendicular to the propagation direction of the laser 135 than when generating a plasma shield for blocking directed-energy weapons. Nonetheless, the energy outputted by the laser source 115 when generating the two different plasma shields may be the same.

Although only one laser source 115 is shown in FIG. 1, the anti-jamming system 110 may include any number of laser sources. Moreover, these laser sources may generate multiple different plasma shield regions 130 around the vehicle 105. These shield regions 130 may be contiguous (i.e., spatially connected) or independent plasma shields. Moreover, multiple lasers may be used to generate the same plasma shield. For example, two or three laser sources may work in synchronization to generate the plasma within region 130.

Figure 2:
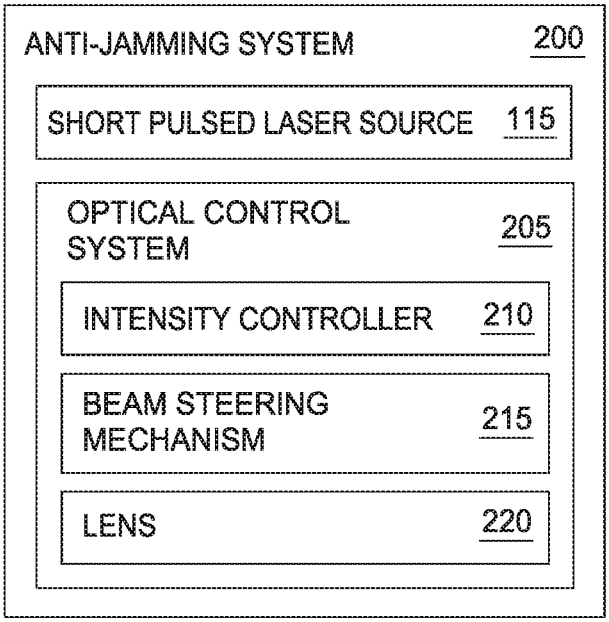
FIG. 2 is a block diagram of an anti-jamming system for countering jamming signals.

FIG. 2 is a block diagram of an anti-jamming system 200 for countering jamming signals. The system 200 includes a short pulsed laser source 115 and an optical control system 205. The pulsed laser source 115 generates short pulses of laser energy (e.g., 1-100 picosecond pulses) rather than a continuous laser signal. Generating plasma requires a high amount of energy, but this energy only needs to be delivered periodically for a short duration. As such, pulsed lasers 115 are well-suited for generating plasmas in free space since these lasers deliver large amounts of energy in short bursts. However, a continuous laser rather than a short pulsed laser may be used so long as the continuous laser can generate sufficient energy to generate plasma in the shield region.

Moreover, to further increase the intensity of laser source 115, the optical control system includes a lens 220 for dictating the focal length of the laser outputted by the source 115. As the beam spot decreases, the energy outputted by the laser source 115 is focused into a smaller area (e.g., a 10-200 micron beam spot) thereby increasing the energy density. This energy is sufficient to cause the molecules within the beam spot to ionize thereby generating a plasma. Thus, for each pulse, the laser source 115 can generate plasma at the focal spot dictated by the lens 220. Moreover, the focal length of the lens 220 may establish the distance between the plasma shield and the vehicle on which the anti-jamming system 200 is mounted.

The optical control system 205 also includes an intensity controller 210 and beam steering mechanism 215. The intensity controller 210 may be a power supply coupled to the laser source 115 that controls the amount of power outputted by the source 115. Moreover, the intensity controller 210 may control the length of the pulses used by the laser source 115. The beam steering mechanism 215 may be an apparatus that generates an electrical field that deflects the laser signal outputted by the pulsed laser source 115. Although mirrors could be used to deflect the laser signal, using mechanical actuators to deflect the laser may take longer thereby reducing how fast the laser source 115 can raster as described below.

Figure 3A:
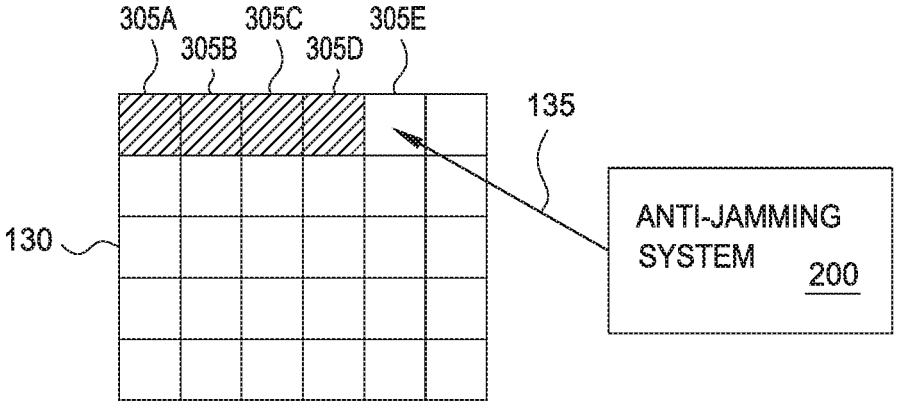
FIGS. 3A and 3B illustrate a 2-D view of a plasma shield generated by an anti-jamming system.
Figure 3B:
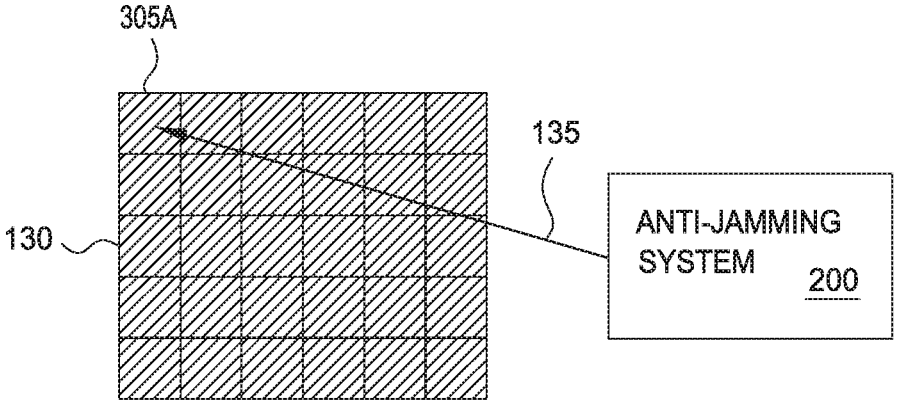

FIGS. 3A and 3B illustrate a 2-D view of a plasma shield generated by an anti-jamming system. Specifically, FIGS. 3A and 3B illustrate a cross sectional view of the region 130 illustrated in FIG. 1. That is, FIGS. 3A and 3B illustrate the view of the plasma shield as seen by the anti-jamming system 200 on the vehicle. In this example, the beam steering mechanism deflects the laser signal outputted by the pulse laser such that the laser signal strikes a different sub-portion 305 (which divide up the region 130) during each pulse. Put differently, for each laser pulse, the beam steering mechanism deflects the direction of the laser signal to a different sub-portion 305 within the region 130. Here, the anti-jamming system 200 first strikes sub-portion 305A and provides enough energy to generate a plasma within this portion 305A as represented by the shaded boxes. During the next pulse, the beam steering mechanism directs the laser signal to the next sub-portion 305B to generate the plasma at this location. In FIG. 3A, the anti-jamming system 200 is currently focusing on sub-portion 305D to generate a plasma at this location.

As shown, plasma persists at sub-portions 305A-D even though the anti-jamming system 200 is no longer injecting energy into these regions. Although it takes only a short pulse to generate the plasma (e.g., 1-100 ps), the plasma may remain in these regions for several microseconds. Thus, sub-portion 305A will continue to contain plasma even after the anti-jamming system 200 has moved on to generate plasma in different sub-portions 305.

FIG. 3B illustrates a complete plasma shield within region 130. That is, the anti-jamming system 200 has completed rastering through the region 130 to generate plasma at each of the sub-portions 305. The particular path the system 200 traverses to strike each of the sub-portions 305 with the laser signal does not matter so long as the system 200 can strike each of the sub-portions 305 before the plasma generated in the first sub-portion 305A has disappeared (e.g., the ionized electrons have recombined with an atom or molecule). For example, if the laser can generate 50 pulses every microsecond and it takes two microseconds before the plasma generated in a sub-portion 305 dissipates, the anti-jamming system 200 can generate a plasma shield that includes 100 sub-portions 305 within region 130.

The size of the region 130 and the sub-portions 305 will vary according to the duration of the pulses, the output energy of the laser, the beam spot or focal length of the laser, and the like. By controlling these factors, the anti-jamming system 200 can generate a plasma shield with the desired dimensions. In one aspect, the anti-jamming system 200 dynamically changes the dimensions of the region 120 or the sub-portions 305 depending on the situation. For example, if the anti-jamming system 200 determines multiple transmitters emitting jamming signals, the intensity controller 210 may increase the dimensions of the shield region 130 by increasing the frequency of the pulses (and number of sub-portions 305) to increase the protection provided by the plasma shield to the vehicle. Moreover, as described above, the anti-jamming system 200 may change the size and density of the plasma shield depending on whether the signals are jamming signals or directed-energy weapons. In another aspect, because different communication systems in the vehicles may use different frequency signals, the anti-jamming system 200 changes the size and density of the plasma shield depending on which communication system the transmitter is attempting to jam since the wavelengths of signals used by the communication systems on the vehicle may vary widely.

Figure 4:
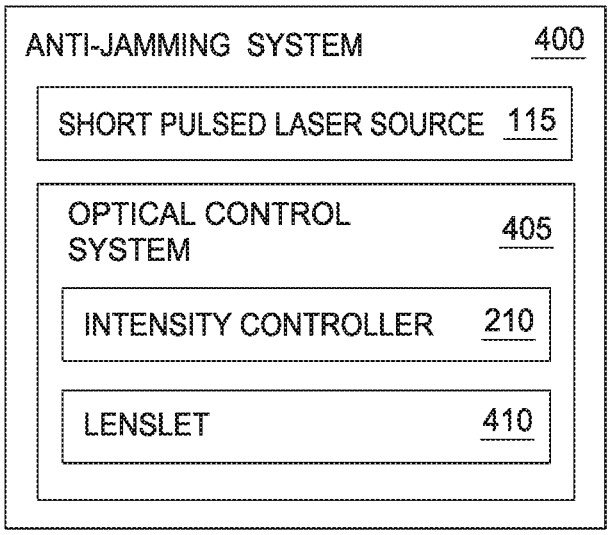
FIG. 4 is a block diagram of an anti-jamming system for countering jamming signals.

FIG. 4 is a block diagram of an anti-jamming system 400 for countering jamming signals. Like in FIG. 2, the anti-jamming system 400 includes the short pulsed laser source 115 and intensity controllers 210 which were described in detail above. The anti-jamming system 400 also includes an optical control system 405 with a lenslet 410. The lenslet 410 may include a beam splitter to split the laser outputted by the laser source 115 into multiple separate laser signals. Each of these signals may correspond to one of the lenses in the lenslet 410. In this manner, the output of a single laser source 115 can be split into multiple different lasers that propagate along different paths simultaneously.

Figure 5:
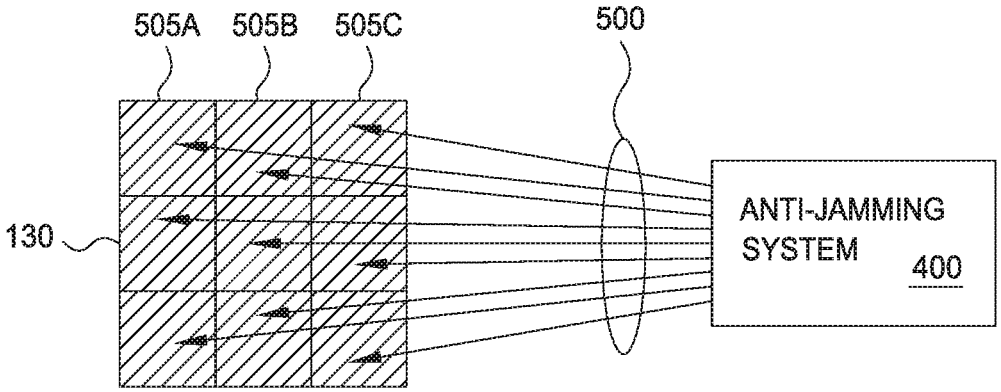
FIG. 5 illustrates a 2-D view of a plasma shield generated by an anti-jamming system.

FIG. 5 illustrates a 2-D view of a plasma shield generated by the anti-jamming system 400. Because of the lenslet 410, the anti-jamming system 400 can output multiple laser signals 500 which strike the plasma shield region 130 simultaneously. Stated differently, the lenslet 410 focuses each of the separate laser signals 500 onto a respective sub-portion 505. For example, the laser signals 500 include different laser signals that simultaneously strike sub-portion 505A, 505B, 505C, etc. In this example, the lenslet includes a respective lens for each of the sub-portions 505 in region 130. Thus, during each pulse of the laser, the anti-jamming system 400 outputs a respective laser signal 500 through the lenslet for each of the sub-portions 505. In this manner, the anti-jamming system 400 generates plasma in each of the sub-portions 505 simultaneously. Like above, the anti-jamming system 400 may use a pulse duration for the laser source 115 that ensures that a new set of laser signals 500 are emitted before the plasma in each of the sub-portions 505 recombine, thereby maintaining the plasma shield. Unlike the rastering technique shown in FIGS. 3A and 3B, in FIG. 5, plasma is generated in multiple (or all) of the sub-portions 505 simultaneously. Thus, the anti-jamming system 400 may be able to generate the complete plasma shield more quickly using the technique illustrated in FIG. 5, as opposed to the technique shown in FIG. 3. However, because the laser signal is split into the plurality of laser signals 500, this technique may use a higher powered laser source than the technique shown in FIGS. 3A and 3B.

Although FIG. 5 illustrates using the lenslet such that each sub-portion 305 within the plasma shield region 130 is struck by the laser signals 500 during each laser burst, this is not a requirement. In another aspect, the anti-jamming system 400 may include a beam steering module that can divert or steer the laser signals 500. For example, the lenslet may output only three laser signals during each laser pulse. Using the beam steering module, the anti-jamming system 400 may control the laser signals 500 such that during a first pulse the laser signals 500 strike the upper row of region 130 (i.e., sub-portions 505A, 505B, and 505C), during a second pulse the laser signals 500 strike the middle row of region 130, and during a third pulse the signals 500 strike the bottom row of region 130. Thus, the lenslet may output multiple laser signals 500 which are then rastered through the region 130 to create the plasma shield using multiple laser pulses. So long as the laser signals 500 are rastered with enough frequency to prevent the plasma in any one of the sub-portions 505 from recombining, the anti-jamming system 400 can maintain a continuous plasma shield in region 130.

Figure 6A:
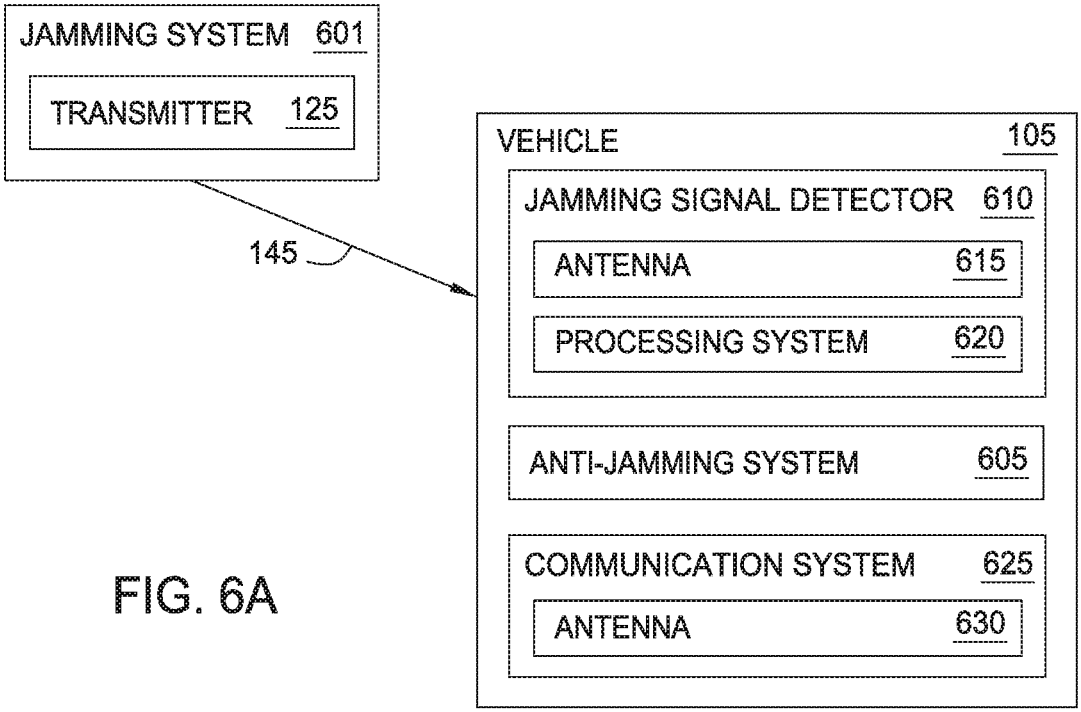
FIGS. 6A and 6B illustrate an anti-jamming system for detecting and countering jamming signals.
Figure 6B:
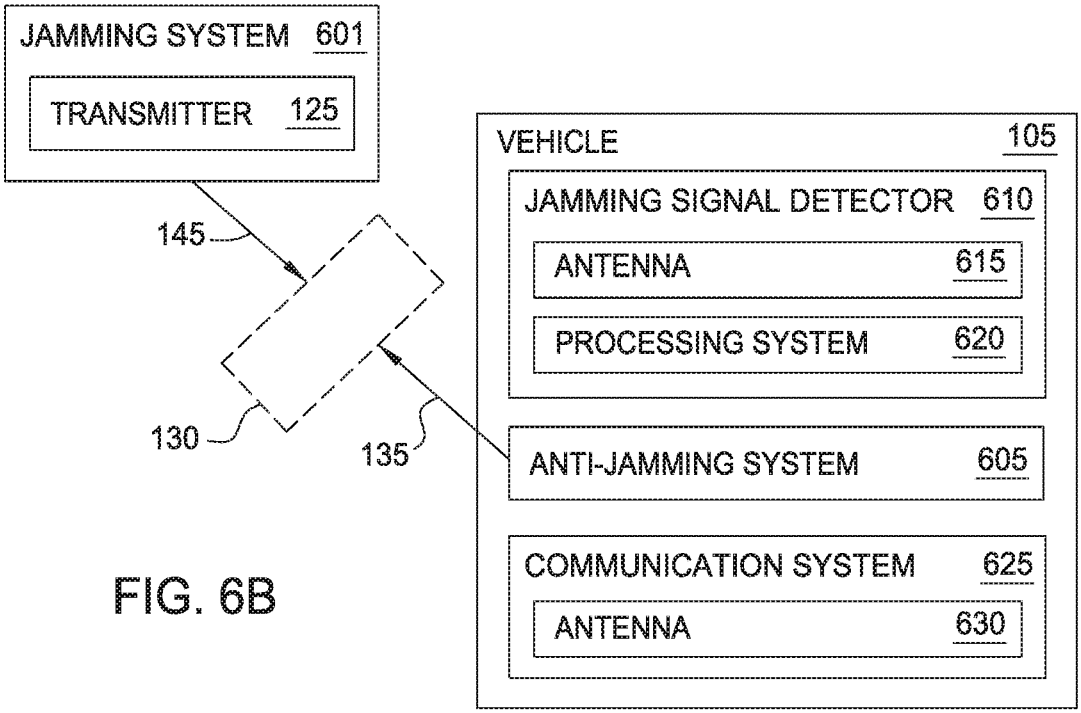

FIGS. 6A and 6B illustrate an anti-jamming system 605 for detecting and countering jamming signals. As shown, environment 600 includes a jamming system 601 and transmitter 125 that outputs jamming signals 145 that strike the vehicle 105. As shown, the vehicle 105 includes a jamming signal detector 610 for identifying jamming signals 145 striking the vehicle 105. Specifically, the detector 610 determines whether received radio waves are desired signals (e.g., communication signals) or undesired signals (e.g., jamming signals 145) intended to interfere with a communication system 625 mounted on the vehicle 105. To do so, the jamming signal detector 610 may evaluate characteristics of received signals such as signal strength, directionality, or content.

The jamming signal detector 610 includes an antenna 615 and processing system 620. The antenna 615 receives the desired and undesired signals that reach the vehicle 105. In one aspect the antenna 615 may include an antenna array for detecting radio waves. The antenna 615 may be stationary, or the detector 610 may move the antenna 615 in order to receive radio waves approaching the vehicle 105 from different directions. Furthermore, the antenna 615 may be a directional antenna that receives radio waves approaching the vehicle 105 from only certain directions. Rotating the antenna 615 may enable the jamming signal detector 615 to identify the propagation direction of the received radio waves.

The processing system 620 (e.g., a computing system or an application executing on a computing system) evaluates the radio waves received by the antenna 615 to determine whether the signal is a jamming signal 145. For example, if the processing system 620 is unable to decode the received signals because, e.g., the signal to noise ratio is too poor, the processing system 620 may categorize the radio waves as jamming signals 145. In another example, if the received noise saturates circuitry in the processing system 620 (indicating the received signals are transmitted with excessive power), the system 620 can identify the signals as jamming signals 145. Moreover, if the radio waves exhibit characteristics of random noise rather than a modulated signal containing data, the processing system 620 characterizes the received signal as a jamming signal. In other aspects, the processing system 620 evaluates the received signal to determine whether the signal transmits constantly in an ad hoc communication channel without allowing other sources to transmit signals, or only sends messages for initiating a handshake protocol without ever initiating data communication, thereby indicating the signal is a jamming signal 145.

Once a received signal is classified as a jamming signal 145, the processing system 620 determines a direction of the jamming signal 145 as the signal approaches the vehicle 105. In one aspect, the processing system 620 uses the antenna 615 to identify the direction corresponding to the largest received power of the jamming signal 145. For example, the processing system 620 may rotate the antenna 615 or use an antenna array to identify the direction of the jamming signal 145.

Although FIG. 6A illustrates only one jamming signal detector 610, in one aspect, the vehicle 105 may include multiple different jamming signal detectors 610 which are tuned to detect jamming signals at different frequencies or frequency ranges. For example, one detector 610 may identify jamming signals in the frequency range of 1-999 MHz while another detector 610 identifies jamming signals in the range of 1-10 GHz. Each of the detectors 610 can independently identify jamming signals and determine a direction the jamming signals approach the vehicle 105.

FIG. 6B illustrates using the anti-jamming system 605 to generate the plasma shield region 130 for blocking the jamming signal 145. After identifying the location of the jamming system 601 by identifying the propagation direction of the signal 145, the anti-jamming system 605 generates plasma in a plasma shield region 130 disposed between the jamming system 601 and the structure—i.e., vehicle 105. In one aspect, the anti-jamming system 605 activates a short pulsed laser to generate plasma within the region 130 which is between the jamming system 605 and the vehicle 105. As discussed above, this region 130 is opaque to the jamming signal 145 which mitigates the likelihood the jamming signal 145 interferes with the communication system 625 on the vehicle 105.

In contrast to directed-energy systems where the laser or microwave signals are concentrated in small areas or paths, the jamming signal 145 may have much larger wavelengths. In some situations, the anti-jamming system 605 may be unable to generate a plasma region 130 large enough to block the entire jamming signal 145, and as such, some of the energy in the jamming signal 145 may reach the vehicle 105. However, because many types of jamming rely on the signal 145 reaching the target vehicle 105 with enough power to interfere with the communication system 625, reducing only some of the power of the jamming signal 145 using the plasma region 130 may be sufficient to prevent the jamming signal 145 from interfering with the communication system 625. That is, although the jamming signal 145 may still have some deleterious effect on the communication system 625 (e.g., decrease the signal to noise ratio), the effect may not be serious enough to prevent a radio receiver in the communication system 625 from receiving and decoding desired radio signals.

Furthermore, unlike directed-energy systems, the jamming signals 145 are more easily reflected by external surfaces to generate multi-path signals. Stated differently, the jamming signals 145 emitted by the transmitter 125 may be reflected by different surfaces, and as a result, strike the vehicle 105 at different directions. In one aspect, the jamming signal detector 610 detects the path of the jamming signal 145 that carries the largest amount of power and instructs the anti-jamming system 605 to arrange the plasma region 130 to block this propagation path. The jamming signals 145 propagating along other paths may have sufficiently lower power values such that these signals 145 do not prevent the communication system 625 from functioning as desired. Alternatively, if the anti-jamming system 605 includes multiple lasers (or the size of the shield region 130 can be increased), the jamming signal detector 610 may identify multiple paths the jamming signals 145 travel when propagating from the transmitter 125 to the vehicle 105 and instruct the anti-jamming system 605 to generate different shield regions 130 (or one large shield region 130) to block each of the paths.

In one aspect, it is not necessary that the anti-jamming system 605 identify the location of the jamming system 605. Put differently, the anti-jamming system 605 does not need to know exactly where the transmitter 125 is in order to block the jamming signals 145. For example, the vehicle may have only certain areas that are affected by the jamming signals 145 (e.g., the antenna 630). When the jamming signal detector 610 detects any jamming signals 145, the anti-jamming system 605 activates a plasma shield region 130 that prevents jamming signals 145 from reaching the susceptible portion of the vehicle from at least one direction. To provide an example, the vehicle 105 may be a ground vehicle that uses communication system 625 and antenna 630 to communicate with other ground vehicles or a nearby ground station. However, the jamming system 605 may be disposed on an enemy aircraft flying over the vehicle 105, as such, the jamming signals 145 approach the vehicle from a direction substantially perpendicular to the ground. Thus, once the jamming signal detector 610 detects the jamming signal 145, the anti-jamming system 605 generates a plasma region 130 that is directly above the antenna 630 of the communication system 625. For example, the plasma region 130 may be arranged along a plane that is parallel to the ground and above the antenna 630. Doing so blocks much of the jamming signal 145 from reaching the antenna 630 but the surrounding region of the antenna 630 (i.e., the sides of the antenna 630) does not have plasma which permits radio waves approaching the vehicle 105 from the sides (e.g., in a direction parallel with the ground) to reach the antenna 630. Thus, the communication system 625 can continue to communicate with other ground vehicles or the ground station while blocking the jamming signals 145. Thus, in this example, by estimating where the jamming system 605 is generally located, the anti-jamming system 605 can generate a shield region to block the jamming signal 145 without the jamming signal detector 610 identifying a precise location of the transmitter 125.

To determine when to deactivate the plasma shield in region 130, after a predefined period of time (e.g., after three to ten seconds) the anti-jamming system 605 may stop outputting the laser 135. If the transmitter 125 is still transmitting the jamming signal 145, the jamming signal detector 610 can again identify the jamming signal 145. If, however, the jamming system 601 is no longer outputting the jamming signal 145, the jamming signal detector 610 instructs the anti-jamming system 605 to keep the laser 135 off. Periodically checking to see if the plasma shield no longer needs to be maintained may be an advantage since the plasma can have a negative effect on the communication systems 625 in the vehicle 105.

Figure 7:
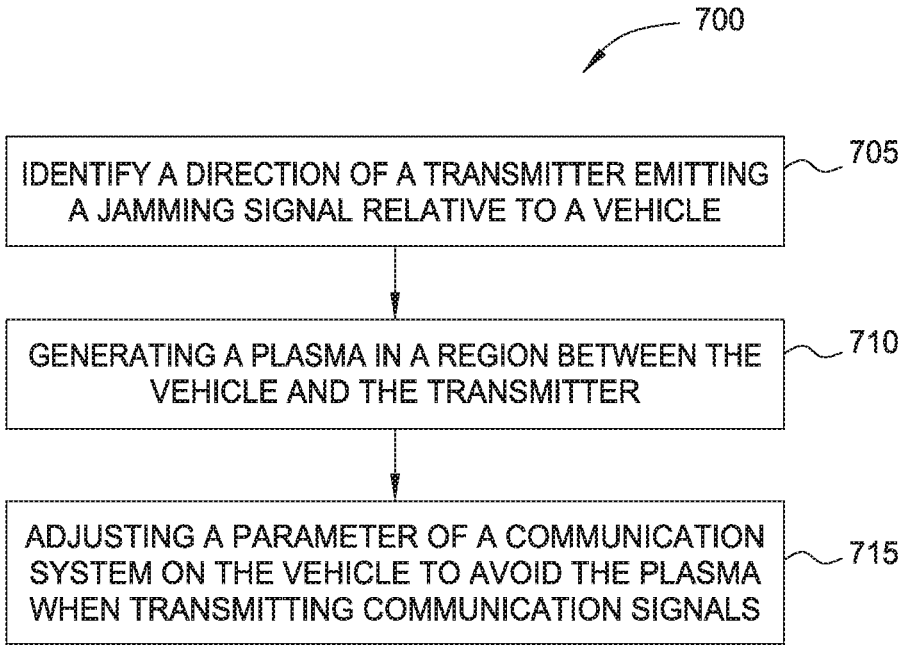
FIG. 7 is a flowchart for adjusting a parameter of a communication system to avoid a plasma region generated to block jamming signals.

FIG. 7 is a flowchart of a method 700 for adjusting a parameter of a communication system to avoid a plasma region generated to block jamming signals. At block 705, the jamming signal detector identifies a direction, relative to the vehicle, of a transmitter emitting a jamming signal. As described above, the jamming signal detector may include an antenna and processing system for determining a location of the transmitter emitting the jamming signals or a propagation path of the jamming signals.

At block 710, the anti-jamming system generates a plasma in a region between the vehicle and the transmitter (or along the propagation path) to mitigate the effect the jamming signals have on a communication system in the vehicle. The plasma can block all or some of the jamming signals such that the jamming signals do not prevent a communication system disposed on the targeted vehicle from receiving desired signals. That is, the plasma does not need to block all of the jamming signals in order to prevent the signals from jamming the communication system.

At block 715, the vehicle adjusts a parameter of the communication system on the vehicle to avoid the plasma when transmitting communication signals. Put differently, because the plasma absorbs both jamming signals (i.e., undesired signals) and communication signals transmitting by the communication system (i.e., desired signals), the vehicle adjusts the communication system to mitigate the effect of the plasma on signals transmitted by the communication system. For example, if the plasma blocks the jamming signals but prevents the communication system from being able to receive or transmit signals, then the plasma is effectively jamming the communication system. As such, in one aspect, the anti-jamming system disposes the plasma in a region such that the communication system can continue to transmit and/or receive radio signals. As used herein, avoiding the plasma region does not necessarily mean the communication signals are not absorbed by the plasma but rather that the parameter changes the communication system so that the amount of energy in the signal that is absorbed by the plasma is reduced relative to not changing the parameter.

In one aspect, the communication system adjusts an antenna parameter which changes how the antenna in the communication system transmits radio waves. For example, the parameter may change the radiation pattern of the antenna such that a main lobe in the pattern is outside the plasma region. In another aspect, the parameter may change the radiation pattern such that a region between lobes in the radiation pattern (which corresponds to a portion of lower power and field strength) aligns with the plasma region, thereby reducing the amount of power of the transmitted signal that is absorbed by the plasma. The parameter may alter the radiation pattern either electronically (as in the case of an antenna array) or mechanically by moving or rotating the antenna.

In another aspect, the communication system may adjust a parameter that weights propagation directions. For example, the system may include multiple antennas responsible from transmitting the communication signals in different directions. The parameter may increase the power used to transmit the signals on the antennas that have radiation patterns that do not include the plasma region and decrease the power using to transmit signals on antennas that have radiation patterns that do include the plasma region. In this manner, the effect of the plasma region on the communication signals transmitted by the communication system can be reduced.

The aspects described herein can be used to prevent or mitigate interference caused by a jamming system on a targeted structure. An anti-jamming system can be mounted on or near the structure and may include a jamming signal detector for identifying a jamming signal. If a jamming signal is detected, the anti-jamming system activates a plasma region between the jamming system and the targeted structure. Because plasma is "dark" or opaque to electromagnetic radiation, the radiation emitted by the jamming system is absorbed by the plasma instead of interfering with a communication system on the structure.

The descriptions of the various aspects have been presented for purposes of illustration, but are not intended to be exhaustive or limited to the aspects disclosed. Many modifications and variations will be apparent to those of ordinary skill in the art without departing from the scope and spirit of the described aspects. The terminology used herein was chosen to best explain the principles of the aspects, the practical application or technical improvement over technologies found in the marketplace, or to enable others of ordinary skill in the art to understand the aspects disclosed herein.

In the preceding paragraphs, reference is made to aspects presented in this disclosure. However, the scope of the present disclosure is not limited to specific described aspects. Instead, any combination of the preceding features and elements, whether related to different aspects or not, is contemplated to implement and practice contemplated aspects. Furthermore, although aspects disclosed herein may achieve advantages over other possible solutions or over the prior art, whether or not a particular advantage is achieved by a given aspect is not limiting of the scope of the present disclosure. Thus, the preceding aspects, features, and advantages are merely illustrative and are not considered elements or limitations of the appended claims except where explicitly recited in a claim(s).

Aspects may take the form of an entirely hardware aspect, an entirely software aspect (including firmware, resident software, micro-code, etc.) or an aspect combining software and hardware aspects that may all generally be referred to herein as a "circuit," "module" or "system."

Aspects may be a system, a method, and/or a computer program product. The computer program product may include a computer readable storage medium (or media) having computer readable program instructions thereon for causing a processor comprising hardware and software to carry out aspects described herein.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices comprising hardware and software from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present aspects may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some aspects, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects are described herein with reference to flowchart illustrations and/or block diagrams of methods, apparatus (systems), and computer program products. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various aspects disclosed herein. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to aspects, other and further aspects may be devised without departing from the basic scope thereof, and the scope thereof is determined by the claims that follow.

What is claimed is:

1. An anti-jamming system, comprising:

a pulsed laser source;

a detector configured to detect a jamming signal and identify a path traversed by the jamming signal; and an optical control system configured to, in response to the detector detecting the jamming signal, direct laser signals emitted by the pulsed laser source to generate a moveable plasma shield in a plasma shield region located along the path traversed by the jamming signal in order to block the jamming signal from reaching a communication system.

2. The anti-jamming system of claim 1, wherein the optical control system is configured to, during each pulse of the pulsed laser source, deflect a respective one of the laser signals to a defined sub-portion of the plasma shield region, wherein the plasma shield region is divided into a plurality of sub-portions.

3. The anti-jamming system of claim 2, wherein the optical control system is configured to, using a plurality of pulses of the pulsed laser source, generate the plasma shield region by rastering the pulsed laser source in a predefined pattern through the plurality of sub-portions.

4. The anti-jamming system of claim 3, wherein the optical control system further comprises a beam steering mechanism configured to deflect the laser signals to raster the pulsed laser source in the predefined pattern.

5. The anti-jamming system of claim 2, wherein the optical control system is configured to generate the plasma shield in multiple sub-portions of the plurality of sub-portions simultaneously by splitting a laser signal emitted during a single pulse of the pulsed laser source into separate laser signals that each focus onto a respective one of the multiple sub-portions.

6. The anti-jamming system of claim 5, wherein the optical control system comprises a lenslet configured to split the laser signal emitted during the single pulse into the separate laser signals.

7. The anti-jamming system of claim 1, further comprising a lens configured to focus the laser signals to establish the plasma shield region at a predefined distance from the communication system.

8. A system comprising:

a jamming signal detector configured to detect a jamming signal configured to interfere with a communication system and identify a path traversed by the jamming signal;

a laser source; and an optical control system configured to, in response to detecting the jamming signal, direct a laser signal emitted by the laser source to generate a moveable plasma shield in a plasma shield region along the path traversed by the jamming signal that blocks the jamming signal from reaching the communication system.

9. The anti-jamming system of claim 1, wherein the detector is further configured to:

detect a plurality of jamming signals, determine, from the plurality of jamming signals, a first jamming signal which carries the largest amount of power, and identify a path traversed by the first jamming signal.

10. The system of claim 8, wherein the laser source does not emit the laser signal until the jamming signal is detected using the jamming signal detector.

11. The system of claim 8, wherein the laser source is a pulsed laser source and the plasma shield region is divided into a plurality of sub-portions, wherein the optical control system is configured to generate plasma in only one of the plurality of sub-portions during each pulse of the laser source.

12. The system of claim 8, wherein the laser source is a pulsed laser source and the plasma shield region is divided into a plurality of sub-portions, wherein the optical control system is configured to generate plasma in multiple sub-portions of the plurality of sub-portions during each pulse of the laser source.

13. The system of claim 8, wherein the communication system comprises an antenna configured to transmit communication signals while the moveable plasma shield is generated.

14. The system of claim 13, wherein the communication system is configured to, in response to detecting the jamming signal, adjust a parameter to avoid the moveable plasma shield when transmitting the communication signals.

15. A method, comprising:

detecting a jamming signal configured to interfere with a communication system;

identifying a path traversed by the jamming signal; and generating, in response to detecting the jamming signal, a moveable plasma shield in a plasma shield region disposed in the path on which the jamming signal traverses to block the jamming signal from reaching the communication system.

16. The method of claim 15, wherein identifying the path traversed by the jamming signal comprises determining a propagation direction of the jamming signal using a detector that receives the jamming signal.

17. The method of claim 15, further comprising:

adjusting, in response to generating the moveable plasma shield, a parameter to avoid the moveable plasma shield when transmitting communication signals using the communication system.

18. The method of claim 15, wherein generating the moveable plasma shield in the plasma shield region further comprises:

rastering a pulsed laser source generating the moveable plasma shield in a predefined pattern to generate the plasma shield region, wherein the predefined pattern divides the plasma shield region into a plurality of sub-portions.

19. The method of claim 18, wherein generating the moveable plasma shield in the plasma shield region further comprises:

repeating the predefined pattern using the pulsed laser source before the plasma in any one of the plurality of sub-portions completely disappears.

20. The method of claim 15, wherein generating the moveable plasma shield in the plasma shield region further comprises:

splitting a laser signal into a plurality of separate laser signals;

focusing each of the separate laser signals onto respective sub-portions of the plasma shield region, wherein the separate laser signals generate plasma in the sub-portions simultaneously.

* * * * *